US007578895B1

(12) United States Patent
Chen et al.

(10) Patent No.: US 7,578,895 B1
(45) Date of Patent: Aug. 25, 2009

(54) PERCHLORATE FREE FLASH BANG COMPOSITIONS FOR PYROTECHNIC TRAINING ROUNDS

(75) Inventors: Gary Chen, Succasunna, NJ (US); Mark Motyka, Fairfield, NJ (US); Jay C. Poret, Sparta, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 167 days.

(21) Appl. No.: 10/907,206

(22) Filed: Mar. 24, 2005

Related U.S. Application Data

(60) Provisional application No. 60/521,272, filed on Mar. 24, 2004.

(51) Int. Cl.

| | |
|---|---|
| ***C06B 33/00*** | (2006.01) |
| ***C06B 33/04*** | (2006.01) |
| ***C06B 31/00*** | (2006.01) |
| ***C06B 31/02*** | (2006.01) |
| ***C06B 31/12*** | (2006.01) |
| ***C06B 31/22*** | (2006.01) |

(52) U.S. Cl. ..... 149/37; 149/43; 149/45; 149/61; 149/62; 149/63

(58) Field of Classification Search ..... 149/37, 149/43, 45, 61, 62, 63
See application file for complete search history.

(56) References Cited

U.S. PATENT DOCUMENTS

| | | | | |
|---|---|---|---|---|
| 3,198,678 | A * | 8/1965 | Zeman et al. | 149/44 |
| 4,349,396 | A * | 9/1982 | Mueller et al. | 149/19.3 |
| 5,735,118 | A * | 4/1998 | Hinshaw et al. | 60/219 |
| 5,780,768 | A * | 7/1998 | Knowlton et al. | 149/36 |
| 6,982,014 | B1 * | 1/2006 | Muneno et al. | 149/19.8 |
| 2004/0108031 | A1 * | 6/2004 | Gast et al. | 149/45 |

* cited by examiner

*Primary Examiner*—Jerry Lorengo
*Assistant Examiner*—James E McDonough
(74) *Attorney, Agent, or Firm*—John F. Moran

(57) ABSTRACT

A perchlorate-free solid pyrotechnic flash bang composition is disclosed, which comprises an oxidizer component selected from the group comprising potassium nitrate, strontium nitrate, and basic copper nitrate and combinations thereof, a metallic fuel component selected from the group comprising aluminum, magnesium, magnesium-aluminum alloys, silicon, zirconium, and combinations thereof, and a non-metallic fuel component comprising sulfur. The flash bang pyrotechnic composition may also further comprise a ballistic accelerant component, a pH stabilizer, and a free flow/anti-caking component.

2 Claims, No Drawings

PERCHLORATE FREE FLASH BANG COMPOSITIONS FOR PYROTECHNIC TRAINING ROUNDS

CROSS REFERENCE TO RELATED APPLICATIONS

This application claims the benefit under 35 USC 199(e) of U.S. Provisional Patent Application No. 60/521,272, filed Mar. 24, 2004, the entire file wrapper contents of which provisional application are herein incorporated by reference as though set forth at length.

FEDERAL RESEARCH STATEMENT

The inventions described herein may be manufactured, used and licensed by or for the U.S. Government for U.S. Government purposes.

BACKGROUND OF THE INVENTION

Field of the Invention

The present invention is directed to solid pyrotechnic compositions. More particularly, the present invention is directed to solid pyrotechnic composition, and methods for making the same, which compositions do not contain any perchlorate compounds and are more environmentally friendly.

Many flash bang or photoflash compositions use perchlorate compound or barium nitrate as the oxidizer. One of the formulations, that the perchlorate free flash bang compositions of the present invention are intended to replace, contains 57.5 weight percent potassium perchlorate and 42.5 weight percent aluminum powder. The specific use of this flash bang composition is in the Army's M115A2 ground burst simulator and the M116A1 hand grenade simulator. M115A2 and M116A1 are used to produce loud report and flash to simulate battle noises and effects during troop maneuvers. M115A2 has an additional feature to simulate the shells in flight with a whistling noise upon initiation.

The process to manufacture flash bang composition for the M115A2 and M116A1 is to pre-dry the aluminum and potassium perchlorate. Then the aluminum and potassium perchlorate are loaded into the round. The round is sealed and tumbled for fifteen or more minutes to complete the mixing.

Despite its simplicity in formulation and mixing process, certain characteristics of the perchlorate containing composition make it highly desirable to replace. One of the recent efforts in the Depart of Defense (DoD) is to mitigate the increasing concern with the extensive use of perchlorate, a critical oxidizer, in many tri-service munitions systems. A preliminary estimate of the current DoD ordnance inventory indicates that over 250 different munitions types contain perchlorate. The concern is that salts of ammonium, potassium, magnesium, or sodium perchlorate dissociate as a contaminant in both ground and surface water. Environmental Protection Agency (EPA) studies show that perchlorates can have an adverse affect on the environment and human health. Several states (Texas, California, Arizona, New York, New Mexico, and Nevada, etc.) have issued guidance on perchlorates in drinking water to protect the public health. High levels of perchlorates were recently found in the ground water of the Aberdeen Proving Ground (APG)/FTX Ordnance Center and School. The excessive perchlorate levels are attributed to potassium perchlorate (KP) used in the flash-bang charge of training rounds such as the M115A2 and the M116A1 simulators. These two items account for majority of the Army's perchlorate usage.

SUMMARY OF THE INVENTION

The present invention provides solid powdered pyrotechnic compositions exhibiting ballistic performance comparable to that of the existing flash bang composition used in the M115A2 and M116A1, but which is formulated without perchlorates or other environmentally incompatible components such as barium nitrate and halogenated compounds.

In accordance with one aspect of the invention, a solid pyrotechnic composition constituting a perchlorate free flash bang composition is provided. The composition comprises about 30.0 weight percent to about 80.0 weight percent oxidizer particles having a mean particle size of not greater than 50 microns. The oxidizer particles comprise at least one member selected from the group of metal nitrates. The preferable metal nitrates comprises of potassium nitrate, strontium nitrate, and or basic copper nitrate. The solid pyrotechnic composition further comprises a metallic fuel about 20.0 weight percent to about 60.0 weight percent having a mean particle size of not greater than 30 microns. The metallic fuel preferable comprises of carbon or graphite coated flake aluminum powder with a high surface area. The solid pyrotechnic composition also comprises a non-metallic fuel about 0.0 weight percent to 15.0 weight percent to facilitate ignition and improve ballistics. The preferable non-metallic fuel comprises of sulfur. The solid pyrotechnic composition may also include 0.0 weight percent to 10.0 weight percent ballistic accelerant, 0.5 weight percent to 2.0 weight percent pH stabilizer, and/or 0.0 weight percent to 5.0 weight percent free flow/anti-caking agent.

In their respective embodiments, the selection of the constituents of these novel perchlorate free flash bang compositions can eliminate the production of harmful chlorinated effluents derived from perchlorate. In this way, the invention may provide an improvement in the environmental impact and worker health risks encountered during deployment and conducting post-fire clean-up operations of articles using the composition. Additionally, the solid pyrotechnic compositions according to the currently preferred embodiments of the present invention may possess improved impact and thermal sensitivities, thereby reducing the incipient hazards of premature ignition via response to stimuli such as radio frequency, impact, friction, heat and/or electrostatic discharge. Still further, addition of a free flow/anti-caking agent can improve the quality of mixing, uniformity of the ballistic properties, processing safety, and the storage stability of the pyrotechnic compositions.

The present invention provides solid powdered pyrotechnic compositions exhibiting ballistic performance comparable to that of the existing flash bang composition used in the M115A2 and M116A1, but which is formulated to not contain perchlorates or other environmentally incompatible components such as barium nitrate and, halogenated compounds.

In accordance with one aspect of the invention, a solid pyrotechnic composition constituting a perchlorate free flash bang composition is provided. The composition comprises about 30.0 weight percent to about 80.0 weight percent oxidizer particles having a mean particle size of not greater than 50 microns. The oxidizer particles comprise at least one member selected from the group of metal nitrates. The preferable metal nitrates comprises of potassium nitrate, strontium nitrate, and or basic copper nitrate. The solid pyrotechnic composition further comprises a metallic fuel about 20.0 weight percent to about 60.0 weight percent having a mean particle size of not greater than 30 microns. The metallic fuel preferable comprises of carbon or graphite coated flake aluminum powder with a high surface area. The solid pyrotechnic composition also comprises a non-metallic fuel about 0.0 weight percent to 15.0 weight percent to facilitate ignition and improve ballistics. The preferable non-metallic fuel comprises of sulfur. The solid pyrotechnic composition may also include 0.0 weight percent to 10.0 weight percent ballistic accelerant, 0.5 weight percent to 2.0 weight percent pH stabilizer, and/or 0.0 weight percent to 5.0 weight percent free flow/anti-caking agent.

In their respective embodiments, the selection of the constituents of these novel perchlorate free flash bang compositions can eliminate the production of harmful chlorinated effluents derived from perchlorate. In this way, the invention may provide an improvement in the environmental impact and worker health risks encountered during deployment and conducting post-fire clean-up operations of articles using the composition. Additionally, the solid pyrotechnic compositions according to the currently preferred embodiments of the present invention may possess improved impact and thermal sensitivities, thereby reducing the incipient hazards of premature ignition via response to stimuli such as radio frequency, impact, friction, heat and/or electrostatic discharge. Still further, addition of a free flow/anti-caking agent can improve the quality of mixing, uniformity of the ballistic properties, processing safety, and the storage stability of the pyrotechnic compositions.

DETAILED DESCRIPTION OF THE INVENTION

The present invention is directed to solid pyrotechnic compositions, perchlorate free flash bang powders, and methods for making the same. More particularly, the present invention is directed to solid pyrotechnic compositions, and methods for making the same, having less environmental impact in comparison to conventional flash bang compositions. The particular embodiments described herein are intended in all respects to be illustrative rather than restrictive. Other and further embodiments will become apparent to those of ordinary skill in the art to which the present invention pertains without departing from its scope.

Solid pyrotechnic compositions prepared according to the methods of the present invention comprise oxidizer particles, non-metallic fuel particles, metallic fuel particles, organic accelerant particles, weak acid particles, and free flow/anti-caking particles.

It is currently preferred that the oxidizer particle comprise from about 30.0 weight percent to about 80.0 weight percent of the solid pyrotechnic compositions. (All percentages provided herein represent percentage by weight of the total solid pyrotechnic composition unless otherwise noted.) It is currently more preferred that oxidizer particles comprise from about 45.0 weight percent to about 60.0 weight percent of the composition.

Further, it is currently preferred that the mean particle size of the oxidizer particles is not greater than about 50 microns. It is currently more preferred that the mean particle size of the oxidizer particles is not greater than about 35 micron, and even more preferred that the mean particle size of the oxidizer particles ranges from about 20 microns to about 35 microns.

The oxidizer particles comprise at least one nitrate salt. It is currently preferred that the nitrate salt comprises at least one member selected from the group consisting of metal nitrate. Exemplary metal nitrates include, without limitation potassium nitrate, strontium nitrate, and basic copper nitrate. Potassium nitrate is the currently preferred nitrate salt and is preferably present in a concentration of between 45.0 weight percent and 60.0 weight percent of the total solid pyrotechnic composition.

It is currently preferred that the non-metallic fuel comprise about 0.0 weight percent to 15.0 weight percent of the total weight of the solid pyrotechnic composition. It is currently more preferred that solid pyrotechnic compositions prepared according to methods of the present invention comprise from about 5 weight percent to about 10 weight percent non-metallic fuel. The non-metallic fuel of choice is, but is not limited to, sulfur. It is preferred that the mean particle size of sulfur is no greater than 50 microns.

It is currently preferred that the metallic fuel comprise about 10.0 weight percent to about 60.0 weight percent of the total weight of the solid pyrotechnic composition. It is currently more preferred that solid pyrotechnic compositions comprise 30.0 weight percent to 50.0 weight percent. It is also currently preferred that the mean particle size of the metallic fuel particles is not greater than about 30 microns. It is currently more preferred that the mean particle size of the metallic fuel particles fall within a range of 0.3 to 25 microns. Exemplary metallic fuels include, without limitation, aluminum, magnesium, magnesium-aluminum alloy, silicon, and zirconium. The types of aluminum considered are flake, conventional (any shape), and spherical aluminum powders. The types of magnesium considered are atomized and ground powers. Carbon or graphite coated flake aluminum powder with a high surface area is the currently preferred metallic fuel and is preferably present in a concentration of between 35.0 weight percent and 45.0 weight percent. The preferred surface areas for flake aluminum are in a range of 0.5 m2/g to 15 m2/g and more preferably in a range of 7 m2/g to 12 m2/g. The carbon or graphite content in aluminum is preferred in a concentration up to 0.5 weight percent.

It is currently preferred that the organic accelerant comprise about 0.0 weight percent to 10.0 weight percent of the total weight of the solid pyrotechnic composition. The more preferred solid pyrotechnic compositions comprise 0.0 weight percent organic accelerant. Exemplary organic accelerants include, without limitation, nitrocellulose, black powder, and commercially available single or double base propellants.

It is currently preferred that the pH stabilizer comprise about 0.5 weight percent to about 2.0 weight percent of the total weight of the solid pyrotechnic composition. It is currently more preferred that solid pyrotechnic compositions comprise 0.5 weight percent to 1.5 weight percent. The pH stabilizer of choice is but is not limited to boric acid.

It is currently preferred that the free flow/anti-caking particles comprise about 0.0 weight percent to about 5.0 weight percent of the total weight of the solid pyrotechnic composition. It is currently more preferred that solid pyrotechnic compositions comprise 0.2 weight percent to 0.8 weight percent. It is also currently preferred that the mean particle length of the free flow/anti-caking agent is not greater than 1 micron. It is currently more preferred that the mean particle length fall within the range of 0.1 to 0.4 microns. The currently preferred free flow/anti-caking agent is silicon dioxide (SiO2). More specifically, the free flow/anti-caking agent of choice is a M5 grade from the Cabot Corporation.

EXAMPLES

Example 1

Several different methods were used to mix and dry the solid pyrotechnic compositions based on the amounts powder required. For small laboratory samples of pyrotechnic powders ingredients were hand blended. Each component of the pyrotechnic composition was weighed out separately and mixed together in a conductive container for 15 to 20 minutes. A preferred formulation comprises 35.0 weight percent carbon or graphite coated flake aluminum with a high surface area, 56.5 weight percent ground strontium nitrate, 7.5 weight percent sulfur, and 1.0 weight percent boric acid. Another preferred formulation comprises 40.0 weight percent carbon or graphite coated flake aluminum with a high surface area (8-10 m2/cc), 54.0 weight percent ground potassium nitrate, 5.0 weight percent sulfur, and 1.0 weight percent boric acid. Typical small batch sizes were about 10-20 grams. These small batches were not dried.

For off-round mixed prototype or full up assembly, larger batches of solid pyrotechnic compositions were made. Each component of the pyrotechnic composition was weighed out separately and mixed together in a common container. A preferred formulation (composition 603) comprises 40.0 weight percent carbon or graphite coated flake aluminum with a high surface area (8-10 m2/cc), 53.5 weight percent ground strontium nitrate (49 microns), 5.0 weight percent sulfur, 1.0 weight percent boric acid, and 0.5 weight percent silicon dioxide. The mixing was completed by placing the ingredients into a conductive rubber container with several rubber stoppers. The container was then placed in tumbler for 20 minutes. The purpose of the rubber stoppers was to break up any clumps of powder and to aid in the overall mixing of the composition. Once the mixing was completed the solid pyrotechnic compositions were placed in an oven at 140° F. for 4 hours to dry. After drying the compositions were loading and assembled for testing. A more preferred method is to pre-blend the dry oxidizer with silicon dioxide before mixing with the remaining ingredients for tumbling. This method does not require rubber stoppers and will provide a more intimate mixing of oxidizer particles and aluminum fuels particles. The fine SiO2 particles in the pre-blending step will prevent agglomeration of oxidizer particles and thus enhance the uniformity of the final composition.

The safety enhanced full up assembly loading required in round mixing. A preferred formulation (composition 604) comprises 40.0 weight percent carbon or graphite coated flake aluminum with a high surface area (8-10 m2/cc), 53.5 weight percent ground potassium nitrate (34 microns), 5.0 weight percent sulfur, 1.0 weight percent boric acid, and 0.5 weight percent silicon dioxide. To accomplish this, dry ingredients had to be premixed into two parts. One part comprised the oxidizer, pH stabilizer, and free flow/anti-caking agent. This part will be referred to as the oxidizer composition. The ingredients for the oxidizer composition were weighed out separately and mixed together in a common container. The mixing was completed by placing the oxidizer composition into a conductive rubber container with several rubber stoppers. The container was then tumbled for 20 minutes. Alternatively, the ingredients for oxidizer composition can be mixed in a V-shape blender. The second part comprised the metallic and non-metallic fuels. This part will be referred to as the fuel composition. The ingredients for the fuel composition were weighed out separately and mixed together in a common container. The mixing was completed by placing the fuel composition into a conductive rubber container with several rubber stoppers. The container was then tumbled for 20 minutes. Alternatively, the ingredients for fuel composition can be mixed in a V-shape blender. Once mixing was completed on both parts each part was dried in a 140° F. oven to dry for 4 hours. After drying the fuel composition was weighed out and added to the round. The oxidizer composition was then weighed out and added to the round on top of the fuel composition. The round was then sealed and secured into the tumbler at about 30 degree angles from the mixing direction. The angles were to enhance the mixing mechanism in two dimensions as the rounds were tumbled end over end. The rounds were tumbled for 1 hour.

Example II

Method to Enhance Mixing and Ballistics with Free Flow/Anti-Caking Agent The "end of mix" for producing perchlorate free flash bang powder is governed by the continuity of the mixture. When the powder is mixed outside of the round, rubber stopper can be used to aid in the mixing and help break up larger chunks of powder. In round mixing only relies on the tumbling of the powder to beak up larger clumps. To assure the in round mix was in uniformity, an M115A2 assembly was prepared in accordance to the in round mixing described in Example I except that a free-flow/anti-caking agent was not incorporated. The round was not permanently sealed and placed in the tumbler to mix. At 15 minute intervals the tumbler was stopped and the round was opened to check the progress of the mixing. After 1 hour of tumbling the contents of the round were emptied for closer examination. Closer inspection of the contents reveled that not all of the oxidizer had been incorporated into the composition and that some of the oxidizer was still present in clumps.

The inability to mix the composition after an hour of in round tumbling without a free-flow/anti-caking agent revealed the need to develop a method to enhance the mixing. Clear polycarbonate tubes of the same length and inner diameter as M115A2 and M116A1 were constructed. Four M115A2 sized tubes and four M116A2 sized tubes were tested. These tubes were loaded and assembled in accordance to the in round mixing described in Example I. One tube of each size contained a full charge of flash-bang composition (70 grams and 33 grams respectively for M115A2 and M116A1) without any free flow/anti-caking agent. One tube of each size contained a 75 weight percent full charge of composition without any free flow/anti-caking agent. One tube of each size contained a full charge of composition with 0.25 weight percent free flow/anti-caking agent. The last tubes of each size contained a full charge of composition with 0.5 weight percent free flow/anti-caking agent. The tubes were placed in the tumbler with the foam holders to keep them at about a 30 degree angle from rotation direction. After 15 minutes of mixing the tubes were visually checked. The four of the tubes containing free flow/anti-caking agents all were visually well mixed after 15 minutes of mixing. The other four tubes still exhibited separation of the powder to varying degrees. The tubes were placed back into the tumbler for another 45 minutes of mixing. After 1 total hour of mixing the tubes were removed and inspected. Seven of the eight tubes appeared to be visually well mixed. The only tube in which separation of the two parts could be seen was in the M115A2 size round with a full charge of composition without free flow/anti-caking agent. The free flow/anti-caking agent used was silicon dioxide (SiO2), M5 or TS-720 grade, from Carbot Corporation. The results are summarized in Table 1:

TABLE 1

Summary of Mixing Enhancement with Silicon Dioxide

| NUMBER | CONTENTS | OBSERVATIONS - 15 Minutes | OBSERVATIONS - 60 Minutes |
|---|---|---|---|
| 1 | 70 Grams 604 (full charge for M115A2 | Not well mixed | Some white still visible |

TABLE 1-continued

Summary of Mixing Enhancement with Silicon Dioxide

| NUMBER | CONTENTS | OBSERVATIONS - 15 Minutes | OBSERVATIONS - 60 Minutes |
|---|---|---|---|
| 2 | 50 grams 604 | Some white still visible | Visually well mixed |
| 3 | 70 grams 604 with 0.25 weight percent SiO2 | Visually well mixed | Visually well mixed |
| 4 | 70 grams 604 with 0.5 weight percent SiO2 | Visually well mixed | Visually well mixed |
| 5 | 33 grams 604 (full charge for M116A1) | Not well mixed | Visually well mixed |
| 6 | 25 grams 604 | Not well mixed | Visually well mixed |
| 7 | 33 grams 604 with 0.25 weight percent SiO2 | Visually well mixed | Visually well mixed |
| 8 | 33 grams 604 with 0.5 weight percent SiO2 | Visually well mixed | Visually well mixed |

Ballistic performance was determined by analyzing the yielded rise time and peak pressure from a 50-cc closed bomb. It was found that the 604 compositions with 0.25 weight percent and 0.5 weight percent SiO2 increased the peak pressure of the same composition without SiO2 by 20 percent and 25 percent respectively.

Example III

Ballistic Improvement Agents

A low level of nitrocellulose (13.1 weight percent nitrogen content) or black powder (BP) can be added to the above 603 or 604 formulations to increase the brisance. A preferred formulation comprises 35.0 weight percent carbon or graphite coated flake aluminum with a high surface area, 56.5 weight percent ground potassium nitrate (34 microns), 5.0 weight percent sulfur, 1.0 weight percent boric acid, 0.5 weight percent silicon dioxide, and 5.0 weight percent nitrocellulose. The mix was prepared in accordance with the Example I off-round mixing procedure and sampled for 50 CC closed bomb testing. Composition 604 with 0.5 weight percent SiO2 is the baseline for comparison. It was found that the nitrocellulose improved the peak pressure of composition 604 by approx. 20 weight percent without affecting rise time significantly. The range and average of peak pressure (psi) and rise time (millisecond) are summarized in Table 2.

TABLE 2

Effect of Ballistic Agent in 50 CC Closed bomb Model

| | Peak Pressure/Rise Time Range, psi/ms | Average psi/ms |
|---|---|---|
| Composition 604, 0.75 g | 283-339/23-44 | 307/32 |
| 95 weight percent composition 604 with 5 weight percent NC, 0.75 g | 336-389/34-36 | 363/35 |

Example IV

Full-up Off-Round Mixing Prove Out and Impact of Charge Weight on Photopic Output and Fragmentation Two preferred formulations (603 and 604 compositions without SiO2) were loaded and assembled in full-up M115A2 and M116A1 simulator in accordance with Example 1 off-round procedure. The objective was to identify an optimal amount of charge weight for each simulator that will yield comparable performance to the perchlorate-based standard simulator (473B composition). It was found that the integrated photopic outputs for the groups with 60 grams (M115A2) and 30 grams (M116A1) of 604 mix were approximately 20 percent below that of the standard group. The photopic output of this mix was improved to a level comparable or better than the standard group when the charge weights were increased to 70 grams and 33 grams respectively for M115A2 and M116A1. It was also found that the 603 mix, 60 grams for M115A2 and 30 grams for M116A1, had over twice amount of integrated photopic output as the standard group. The photopic out and sound intensity data are summarized in Tables 3 and 4. It should be note that the sound intensities of 603 and 604 mixes at each selected level of charge weight had met the minimum user requirement, although they were slightly below than that of the standard group.

TABLE 3

Photopic Output and Sound Intensity of Perchlorate Free M115A2 (without SiO2)

| Performance | M115A2 | M115A2 | M115A2 | M115A2 |
|---|---|---|---|---|
| Average of 5 Rounds | 473B (Standard) Ambient | 604-60 g Ambient | 604-70 g Ambient | 603-60 g Ambient |
| Integrated Photopic Output (Cd*sec) | 120480 | 98778 | 158780 | 287140 |
| Sound Intensity (db), 50 ft | 155.8 | 149.1 | 150.4 | 147.1 |

TABLE 4

Photopic Output and Sound Intensity of Perchlorate Free M116A1 (without SiO2)

| Performance | M116A1 | M116A1 | M116A1 | M116A1 |
|---|---|---|---|---|
| Average of 5 Rounds | 473B (Standard) Ambient | 604-30 g Ambient | 604-3 g Ambient | 603-30 g Ambient |
| Integrated Photopic Output (Cd*sec) | 63540 | 50300 | 68100 | 155480 |
| Sound Intensity (db), 50 ft | 151.6 | 150.9 | 148.5 | 144.8 |

Another finding is that a minimum of 60 grams of 603 or 604 mix for M115A2 and 30 grams of the same mix for M116A1 were required to fragment the simulator charge housing body to pieces. Moreover, the 604 mix yielded better fragmentation and sound report than 603 mix at the same level of charge weight. The above data also suggest the optimal charge weights to achieve comparable or better photopic output, sound report, and fragmentation are 70 grams for M115A2 and 33 grams for M116A1 based on the improved fragmentation was observed in 604 groups at these two levels.

Example V

Full-Up M115A2 and M115A1 In-Round Mixing Prove Out and Impact of Silicon Dioxide on Fragmentation Two preferred formulations (603 and 604 compositions with 0.5 weight percent SiO2) were loaded and assembled in full-up M115A2 and M116A1 simulator in accordance with Example 1 in-round mixing procedure. An optimal amount of each mix, 70 grams for M115A2 and 33 grams for M116A1 was loaded in the item for performance testing. Results show that the in-round mixing. Results show that the safety enhanced in-round mixing improved the fragmentation and sound intensity of 604-based simulators while providing the same level of visual photopic output as the off-round mixing. In comparison, the sound level and fragmentation of 603 based simulators were slightly lower while proving significantly higher photopic output than the simulators with 604 and standard mixes. In summary, this prove-out demonstrated silicon dioxide is an effective processing aid for in-round mixing and improvement in fragmentation. Table 5 and 6 are the summary of test data.

TABLE 5

Photopic Output and Sound Intensity of Perchlorate Free M115A2 (with SiO2)

| Performance | M115A2 | M115A2 | M115A2 |
|---|---|---|---|
| Average of 5 Rounds | 473 (Standard) Ambient | 604-70 g Ambient | 603-70 g Ambient |
| Integrated Photopic Output (Cd*sec) | 120480 | 146000 | 297000 |
| Sound Intensity (db), 50 ft. | 155.8 | 154.1 | 147.3 |

TABLE 6

Photopic Output and Sound Intensity of Perchlorate Free M116A1 (with SiO2)

| Performance | M116A1 | M116A1 | M116A1 |
|---|---|---|---|
| Average of 5 Rounds | 473B (Standard) Ambient | 604-33 g Ambient | 603-33 g Ambient |
| Integrated Photopic Output (Cd*sec) | 63540 | 69200 | 14500 |
| Sound Intensity (db), 50 ft | 151.6 | 154.2 | 146.3 |

What is claimed is:

1. A perchlorate-free solid pyrotechnic flash bang composition consisting essentially of:

an oxidizer component consisting essentially of:

an oxidizer component consisting essentially of from about forty-five weight percent (45.0%) to about sixty weight percent (60.0%) potassium nitrate, and wherein the mean particle size of the oxidizer particles is from about twenty microns (20.0 μm) to about thirty-five microns (35 μm);

a pH stabilizer component consisting essentially of from about five-tenths of one weight percent (0.5%) to about one an one-half weight percent (1.5%) boric acid; and a free flow/anti-caking component consisting essentially of from about two-tenths of one weight percent (0.2%) to about eight-tenths of one weight percent (0.8%), and has a mean particle length of from about one-tenths micron (0.1 μm) to about four-tenths micron (0.4 μm) and consists essentially of silicon dioxide;

a fuel component consisting essentially of:

a metallic fuel component consisting essentially of from about thirty-five weight percent (35%) to about forty-five weight percent (45.0%) flaked aluminum particles coated with carbon or graphite comprising up to about one-half of one weight percent (0.5%) of the composition, and wherein said flaked aluminum particles have a mean particle size from about three-tenths micron (0.3 μm) to about twenty-five microns (25.0 μm), and a surface area of from about seven square meters per gram (7 $m^2/g$) to about twelve square meters per gram (12 $m^2/g$); and a non-metallic fuel component consisting essentially of about five weight percent (5.0%) to about ten weight percent (10.0%) of a non-metallic fuel consisting essentially of sulfur, wherein said sulfur has a mean particle size no greater than about fifty microns (50.0 μm); and a ballistic accelerant component consisting essentially of from about zero weight percent (0.0%) to about ten weight percent (10.0%), said ballistic accelerant component selected from the group consisting of nitrocellulose, black powder, and commercially available single or double base propellants.

2. The composition of claim 1 made by combining the blended oxidizer, the blended fuel and the ballistic accelerant in a training round such that a final blending of all of the components is performed in-round.

* * * * *